US010650619B2

(12) United States Patent
Watanabe et al.

(10) Patent No.: US 10,650,619 B2
(45) Date of Patent: May 12, 2020

(54) RELAY DEVICE, SYSTEM, AND METHOD FOR RELAYING MESSAGES BETWEEN VEHICLES

(71) Applicant: TOYOTA JIDOSHA KABUSHIKI KAISHA, Toyota-shi, Aichi-ken (JP)

(72) Inventors: Isao Watanabe, Tokyo (JP); Takashi Yasuda, Tokyo (JP); Takashi Matsuura, Tokyo (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 16/256,564

(22) Filed: Jan. 24, 2019

(65) Prior Publication Data

US 2019/0236857 A1 Aug. 1, 2019

(30) Foreign Application Priority Data

Jan. 26, 2018 (JP) ..... 2018-011913

(51) Int. Cl.

| | |
|---|---|
| ***G08G 1/09*** | (2006.01) |
| ***G07C 5/00*** | (2006.01) |
| ***G07B 15/02*** | (2011.01) |
| ***G07B 13/04*** | (2006.01) |
| ***G07C 9/20*** | (2020.01) |

(52) U.S. Cl.

CPC ..... *G07C 5/008* (2013.01); *G07B 13/045* (2013.01); *G07B 15/02* (2013.01); *G07C 9/20* (2020.01)

(58) Field of Classification Search

None

See application file for complete search history.

(56) References Cited

U.S. PATENT DOCUMENTS

| | | | | |
|---|---|---|---|---|
| 2019/0159211 | A1* | 5/2019 | Belagal Math | H04W 4/46 |
| 2019/0223237 | A1* | 7/2019 | Hong | G05D 1/0022 |

FOREIGN PATENT DOCUMENTS

| | | | |
|---|---|---|---|
| JP | 4852194 | B2 | 1/2012 |
| JP | 2012-029259 | A | 2/2012 |
| JP | 2012-175512 | A | 9/2012 |
| JP | 2014-011666 | A | 1/2014 |
| WO | 99/54830 | A1 | 10/1999 |

* cited by examiner

*Primary Examiner* — Adolf Dsouza

(74) *Attorney, Agent, or Firm* — Hunton Andrews Kurth LLP

(57) ABSTRACT

An on-vehicle relay device that is connected to a first on-vehicle device and a second on-vehicle device via an on-vehicle network, and relays a message transmitted from the first on-vehicle device to the second on-vehicle device, includes a processor configured to receive a permission request for transmission of a first message from the first on-vehicle device, determine whether the total of the usage rate of the bandwidth of the on-vehicle network used by at least one message already permitted to be transmitted via the on-vehicle network, and the usage rate of the bandwidth of the on-vehicle network used by the first message is equal to or smaller than a predetermined threshold value, and send a reply that permits transmission of the first message, to the first on-vehicle device, when the sum is equal to or smaller than the predetermined threshold value.

20 Claims, 9 Drawing Sheets

FIG. 5

211

| MESSAGE ID | DATA SIZE (KB) | URGENCY FLAG |
|---|---|---|
| 0001 | 30 | NORMAL |
| 0002 | 100 | NORMAL |
| 0003 | 5000 | URGENT |
| ⋮ | ⋮ | ⋮ |

FIG. 7

212

| MESSAGE ID | PRIORITY | USAGE RATE OF BANDWIDTH OF EACH BUS (NETWORK) |
|---|---|---|
| 0001 | 1 | FROM INFORMATION PROCESSING DEVICE 10A TO RELAY DEVICE 20: 30%<br>FROM RELAY DEVICE 20 TO INFORMATION PROCESSING DEVICE 10C: 30% |
| 0002 | 2 | FROM INFORMATION PROCESSING DEVICE 10A TO RELAY DEVICE 20: 15%<br>FROM RELAY DEVICE 20 TO INFORMATION PROCESSING DEVICE 10C: 15% |
| 0003 | 3 | FROM INFORMATION PROCESSING DEVICE 10B TO RELAY DEVICE 20: 20%<br>FROM RELAY DEVICE 20 TO INFORMATION PROCESSING DEVICE 10C: 20% |
| ⋮ | ⋮ | ⋮ |

FIG. 8

213

| MESSAGE ID | USAGE RATE OF BANDWIDTH OF EACH BUS (NETWORK) | | | | TIMEOUT PERIOD |
|---|---|---|---|---|---|
| | FROM INFORMATION PROCESSING DEVICE 10A TO RELAY DEVICE 20 | FROM RELAY DEVICE 20 TO INFORMATION PROCESSING DEVICE 10C | FROM INFORMATION PROCESSING DEVICE 10B TO RELAY DEVICE 20 | ... | |
| 0001 | 30% | 30% | — | ... | TIMEOUT PERIOD A |
| 0002 | 15% | 15% | — | ... | TIMEOUT PERIOD B |
| 0003 | — | 20% | 20% | ... | TIMEOUT PERIOD C |
| ⋮ | ⋮ | ⋮ | ⋮ | ⋮ | ⋮ |

RELAY DEVICE, SYSTEM, AND METHOD FOR RELAYING MESSAGES BETWEEN VEHICLES

INCORPORATION BY REFERENCE

The disclosure of Japanese Patent Application No. 2018-011913 filed on Jan. 26, 2018 including the specification, drawings and abstract is incorporated herein by reference in its entirety.

BACKGROUND

1. Technical Field

The disclosure relates to an on-vehicle relay device, relay device, relaying method, information processing device, information processing system, and vehicle.

2. Description of Related Art

As one example of a network system, such as an on-vehicle network system, a system in which communications are performed between nodes via a switch, using Ethernet (registered trademark), has been considered. In the network system using the Ethernet, a receiver-side node that receives data, using Transmission Control Protocol (TCP), or the like, establishes connection of communications with a transmitter-side node. When the connection is established, a receiving buffer for temporarily storing data received using the connection is secured on a memory, such as a random access memory (RAM).

SUMMARY

When two or more connections for receiving data having a relatively low priority and a relatively small size are established in the receiver-side node, for example, data having a relatively high priority and a relatively large size may be unexpectedly transmitted from the transmitter-side node, as will be discussed below.

In this case, according to the related art, a packet loss, such as a loss of data having a relatively low priority, may occur in the switch, and delay in transmission of the data may be increased. As a result, the receiving buffer for connection used for receiving the data is secured, for an increased length of time.

At this time, if a receiving buffer having a sufficiently large size for connection used for receiving the data having the relatively high priority and relatively large size cannot be secured, due to restrictions on the capacity of the RAM included in the receiver-side node, a delay may arise in transmission of the data.

The disclosure provides a technology that can reduce delay in communications.

An on-vehicle relay device according to a first aspect of the disclosure is connected to two or more on-vehicle devices via an on-vehicle network, and relays a message transmitted from a first on-vehicle device as one of the two or more on-vehicle devices, to a second on-vehicle device as another one of the on-vehicle device. The on-vehicle relay device includes a processor configured to receive a permission request for transmission of a first message from the first on-vehicle device, determine whether a sum of a usage rate of a bandwidth of the on-vehicle network used by at least one message already permitted to be transmitted via the on-vehicle network, and the usage rate of the bandwidth of the on-vehicle network used by the first message is equal to or smaller than a predetermined threshold value, and send a reply that permits transmission of the first message, to the first on-vehicle device, when the sum is equal to or smaller than the predetermined threshold value.

With this configuration, the on-vehicle relay device prevents connection of communications in which the usage rate of the bandwidth of the on-vehicle network exceeds the upper limit, and a packet loss may occur, from being established. Accordingly, delay in communications can be reduced.

Also, in the above aspect of the disclosure, the usage rate of the bandwidth of the on-vehicle network used by the first message may be a pre-set value. In this case, when the usage rate of the bandwidth used by each message is known, at the time of shipping from a factory, for example, the delay in communications can be reduced.

Also, in the above aspect of the disclosure, the processor may be configured to receive a plurality of permission requests for transmission of a plurality of messages, from one or more of the two or more on-vehicle devices. The processor may be configured to, when the processor receives the permission requests, and a sum of usage rates of the bandwidth of the on-vehicle network used by the respective messages is equal to or smaller than a predetermined threshold value, send a reply that permits transmission of each of the plurality of messages, to a corresponding one of the one or more on-vehicle devices, in descending order of priority associated with each of the plurality of messages. With this configuration, the on-vehicle relay device permits transmission of the messages, in descending order of priority. Thus, delay in communications having a relatively high priority can be reduced.

In the above aspect of the disclosure, relay device as described above, the processor may be configured to receive a permission request for transmission of a second message, from a third on-vehicle device as one of the two or more on-vehicle devices connected via the on-vehicle network. The processor may be configured to, when the processor receives a notification indicating completion of transmission of the first message permitted to be transmitted, or does not receive the notification from the first on-vehicle device within a predetermined period, finish operation to transmit the first message, and determine whether a sum of the usage rate of the bandwidth of the on-vehicle network used by at least one message already permitted to be transmitted via the on-vehicle network, and the usage rate of the bandwidth of the on-vehicle network used by the second message that has not been permitted to be transmitted, is equal to or smaller than a predetermined threshold value. The processor may be configured to send a reply that permits transmission of the second message, to the third on-vehicle device, when the sum is equal to or smaller than the predetermined threshold value. With this configuration, when transmission of the message permitted to be transmitted is completed, for example, transmission of another message is permitted. Accordingly, delay in communications having a relatively high priority can be reduced.

In the on-vehicle relay device as described above, the processor may be configured to calculate the predetermined period, based on a data size of the message permitted to be transmitted, and the usage rate of the bandwidth of the on-vehicle network used by the message. With this configuration, the waiting time for receiving the notification indicating completion of transmission of the message permitted to be transmitted is set according to the time required to transmit the message. Accordingly, the waiting time can be appropriately set.

In the on-vehicle relay device as described above, the processor may be configured to, when the processor receives a permission request for transmission of a third message, from a fourth on-vehicle device as one of the two or more on-vehicle devices connected via the on-vehicle network, send a reply that stops transmission of the first message permitted to be transmitted, to the first on-vehicle device, and send a reply that permits transmission of the third message, to the fourth on-vehicle device. The third message may have a higher urgency than the first message. With this configuration, a message, such as an urgent message, is transmitted after stopping transmission of another message. Thus, delay in communications can be reduced.

A second aspect of the disclosure is a relay device that relays a message transmitted between a plurality of information processing devices connected via a network. The relay device includes a processor configured to receive a permission request for transmission of a first message; determine, when receiving the permission request, whether a sum of a usage rate of a bandwidth of the network used by at least one message already permitted to be transmitted via the network, and the usage rate of the bandwidth of the network used by the first message is equal to or smaller than a predetermined threshold value; and send back a reply that permits transmission of the first message, when the sum is equal to or smaller than the predetermined threshold value.

A third aspect of the disclosure is a relaying method that is performed by a relay device that is connected to a first information processing device and a second information processing device via a network, and relays a message transmitted from the first information processing device, to the second information processing device. The relaying method includes: receiving a request to permit transmission of a first message from the first information processing device; determining whether a sum of a usage rate of a bandwidth of the network used by at least one message already permitted to be transmitted via the network, and the usage rate of the bandwidth of the network used by the first message is equal to or smaller than a predetermined threshold value; and sending a reply that permits transmission of the first message, to the first information processing device, when the sum is equal to or smaller than the predetermined threshold value.

A fourth aspect of the disclosure is an information processing device that includes a processor. The processor configured to send a request to permit transmission of a first message, to a relay device; and send the first message to another information processing device via the relay device when receiving a reply that permits transmission of the first message, from the relay device.

A fifth aspect of the disclosure is an information processing system including a first information processing device; a second information processing device; and a relay device connected to the first information processing device and the second information processing device via a network. The relay device is configured to relay a message transmitted from the first information processing device, to the second information processing device, receive a permission request for transmission of a first message from the first information processing device, determine, when receiving the permission request, whether a sum of a usage rate of a bandwidth of the network used by at least one message already permitted to be transmitted via the network, and the usage rate of the bandwidth of the network used by the first message is equal to or smaller than a predetermined threshold value, and send a reply that permits transmission of the first message, to the first information processing device, when the sum is equal to or smaller than the predetermined threshold value. The first information processing device is configured to send the permission request for transmission of the first message, to the relay device, receive the reply that permits transmission of the first message from the relay device, and send the first message to the second information processing device via the relay device, when receiving the reply.

A sixth aspect of the disclosure is a vehicle having the on-vehicle relay device according to the first aspect.

According to the above aspects of the disclosure, delay in communications can be reduced.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein:

FIG. 5 is a view showing one example of a request list according to the embodiment;

FIG. 7 is a view showing one example of message management data according to the embodiment;

FIG. 8 is a view showing one example of bandwidth management data according to the embodiment;

DETAILED DESCRIPTION OF EMBODIMENTS

Embodiments of the disclosure will be described based on the drawings.

System Configuration

Figure 1:
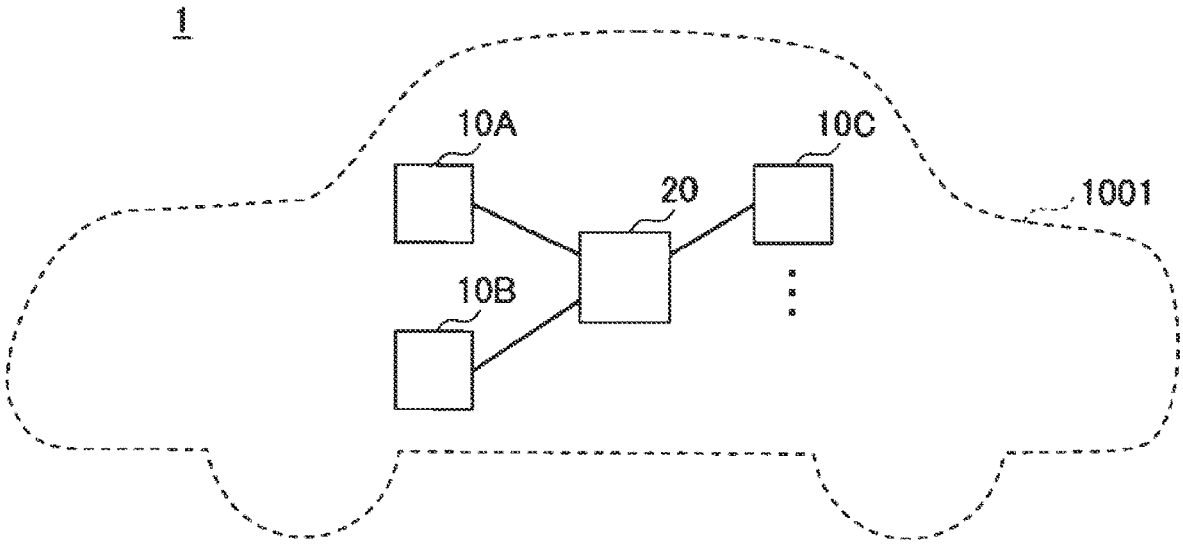
FIG. 1 is a view showing an example of the configuration of a communication system according to one embodiment.

FIG. 1 shows an example of the configuration of an information processing system 1 according to one embodiment. In FIG. 1, the information processing system 1 has an information processing device 10A, information processing device 10B, information processing device 10C, . . . (which will be simply called "information processing device 10" when they need not be distinguished from one another). The information processing system 1 also has a relay device 20. The number of the relay device or devices 20 is not limited to that of the example of FIG. 1.

Each of the information processing devices 10 and the relay device 20 are connected via a network, such as Ethernet. The relay device 20 is a switch, or the like, which relays communications between the information processing devices 10.

As one example, the information processing system 1 is installed on a vehicle 1001 (not shown). More specifically, an on-vehicle system will be described by way of example, in which on-vehicle devices (on-vehicle electronic control units (ECU)) as one example of the information processing devices 10 are connected by an on-vehicle LAN (on-vehicle network), via an on-vehicle relay device as one example of the relay device 20.

However, the technology of this disclosure can be applied to various devices, various relay devices, etc. in various network systems, like the information processing system 1, including network systems for device control within apparatuses, such as robots, aircrafts, satellites, and game machines, network systems for device control in factories, etc., and Internet of Things (IoT) systems connecting sensors, etc. to clouds, etc.

Hardware Configuration

Figure 2:
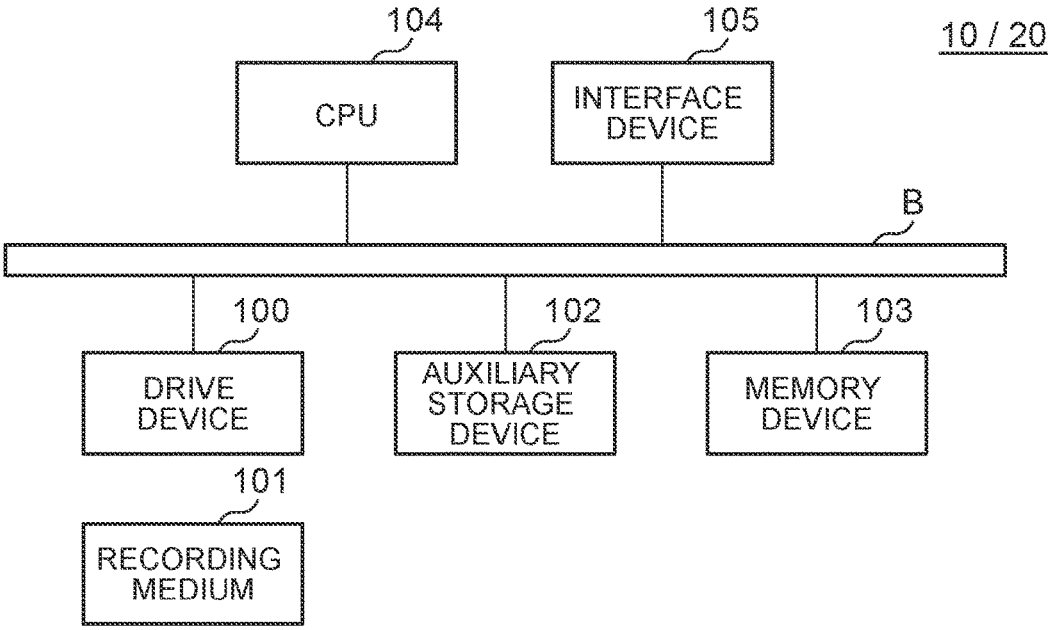
FIG. 2 is a view showing an example of the hardware configuration of an information processing device and a relay device according to the embodiment.

FIG. 2 shows an example of the hardware configuration of the information processing device 10 and relay device 20 according to the embodiment. In the following, the relay device 20 will be illustrated as an example. The relay device 20 of FIG. 2 has a drive device 100, auxiliary storage device 102, memory device 103, central processing unit (CPU) 104, interface device 105, and so forth, which are connected to each other via a bus B.

An information processing program that realizes processing in the relay device 20 is provided by a recording medium 101, for example. When the recording medium 101 in which the information processing program is recorded is set in the drive device 100, the information processing program read from the recording medium 101 is installed in the auxiliary storage device 102 via the drive device 100. However, the information processing program is not necessarily installed by means of the recording medium 101, but may be downloaded from another computer, via a network. The auxiliary storage device 102 stores the information processing program thus installed, and also stores necessary files, data, etc.

The memory device 103, which is, for example, a random access memory (RAM), reads the program from the auxiliary storage device 102 and stores it, when a command to start the program is generated. The CPU 104 implements a function associated with the relay device 20, according to the program stored in the memory device 103. The interface device 105 is used as an interface for connecting the relay device 20 to a network. The interface device 105 is provided for each of two or more network ports provided in the relay device 20, for example.

As one example of the recording medium 101, a portable recording medium, such as CD-ROM, DVD, or USB memory, may be used. As one example of the auxiliary storage device 102, a hard disc drive (HDD), or a flash memory may be used. Both of the recording medium 101 and the auxiliary storage device 102 correspond to computer-readable recording mediums.

The hardware configuration of the information processing device 10 may be similar to that of the relay device 20. The information processing device 10 may include only one interface device 105.

Functional Configuration

Figure 3:
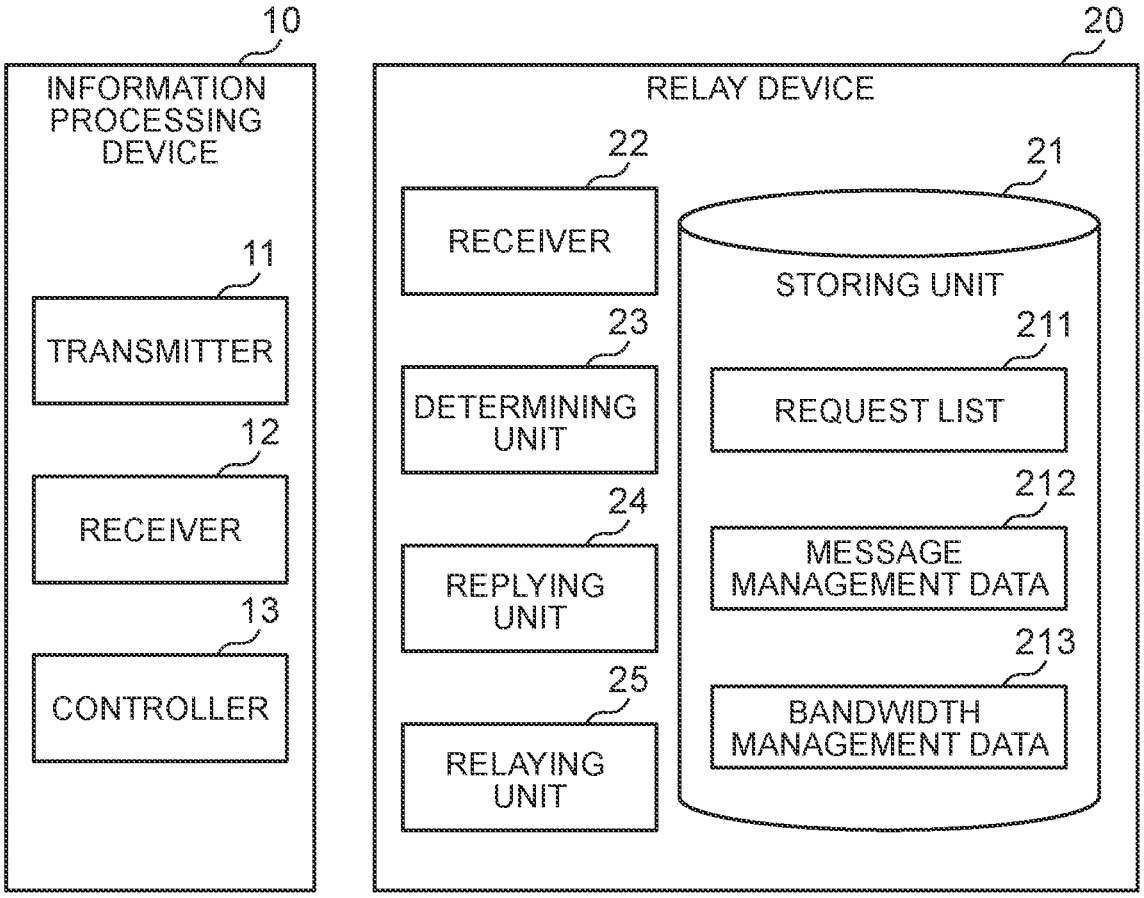
FIG. 3 is a view showing one example of a functional block diagram of the information processing device and relay device according to the embodiment.

Referring next to FIG. 3, the functional configuration of the information processing device 10 and relay device 20 according to the embodiment will be described. FIG. 3 shows one example of a functional block diagram of the information processing device 10 and relay device 20 according to the embodiment.

The information processing device 10 has a transmitter 11, receiver 12, and controller 13. The transmitter 11, receiver 12, and controller 13 represent functions implemented through processing executed by the CPU of the information processing device 10, according to one or more programs installed in the information processing device 10.

The transmitter 11 sends a request to permit transmission of a message as a given type of data processed using an application, to the relay device 20, before sending the message. The message may be data, such as updating data used when updating software of another information processing device 10, or data of an image of an obstacle when the obstacle is detected based on an image of an on-vehicle camera, for example.

When the receiver 12 receives a reply of approval to the request from the relay device 20, the transmitter 11 divides the data of the message directed by the controller 13 to be transmitted, into a plurality of segments each having a predetermined size. Then, the transmitter 11 generates a frame of Ethernet, or the like, including each segment into which the data is divided, and sequentially sends the frames thus generated, to another information processing device 10, via the relay device 20.

The receiver 12 receives replies from the relay device 20, messages from other information processing devices 10, and so forth.

The controller 13 causes the transmitter 11 to send messages to other information processing devices 10 in irregular timing. The data size of the message may be several megabytes (MB), for example.

The relay device 20 has a storing unit 21. The storing unit 21 is realized using the auxiliary storage device 102, etc., for example. The storing unit 21 stores a request list 211, message management data 212, bandwidth management data 213, etc. Data stored in the request list 211, message management data 212, and bandwidth management data 213 will be described later.

The relay device 20 has a receiver 22, determining unit 23, replying unit 24, and relaying unit 25. Each of the receiver 22, determining unit 23, replying unit 24, and relaying unit 25 represents a function realized through processing executed by the CPU of the relay device 20, according to one or more programs installed in the relay device 20.

The receiver 22 receives a request for permission of transmission of a message, from one or more information processing devices 10.

The determining unit 23 determines whether the transmission permission request received by the receiver 22 is approved or denied. When a request to permit transmission of a given message is received, the determining unit 23 permits transmission of the given message, when the sum of the usage rate of the bandwidth of a bus (one example of "network") between the relay device 20 and the information processing device 10, which is used by another message already permitted to be transmitted, and the usage rate of the bandwidth of the bus used by the given message, is equal to or smaller than a predetermined threshold value.

Also, the determining unit 23 calculates a timeout period (one example of "predetermined period"), based on the data size of the message permitted to be transmitted, and the usage rate of the bandwidth of the bus used by the message. Then, when a notification indicating completion of transmission of this message is not received within the timeout period, the determining unit 23 determines whether a request to permit transmission of another message is approved or denied. The determining unit 23 is one example of "calculating unit" that calculates the timeout period.

The replying unit 24 sends a reply indicating approval or denial of the transmission permission request determined by the determining unit 23, back to the corresponding information processing device 10. The relaying unit 25 relays messages between two or more information processing devices 10.

Figure 4:
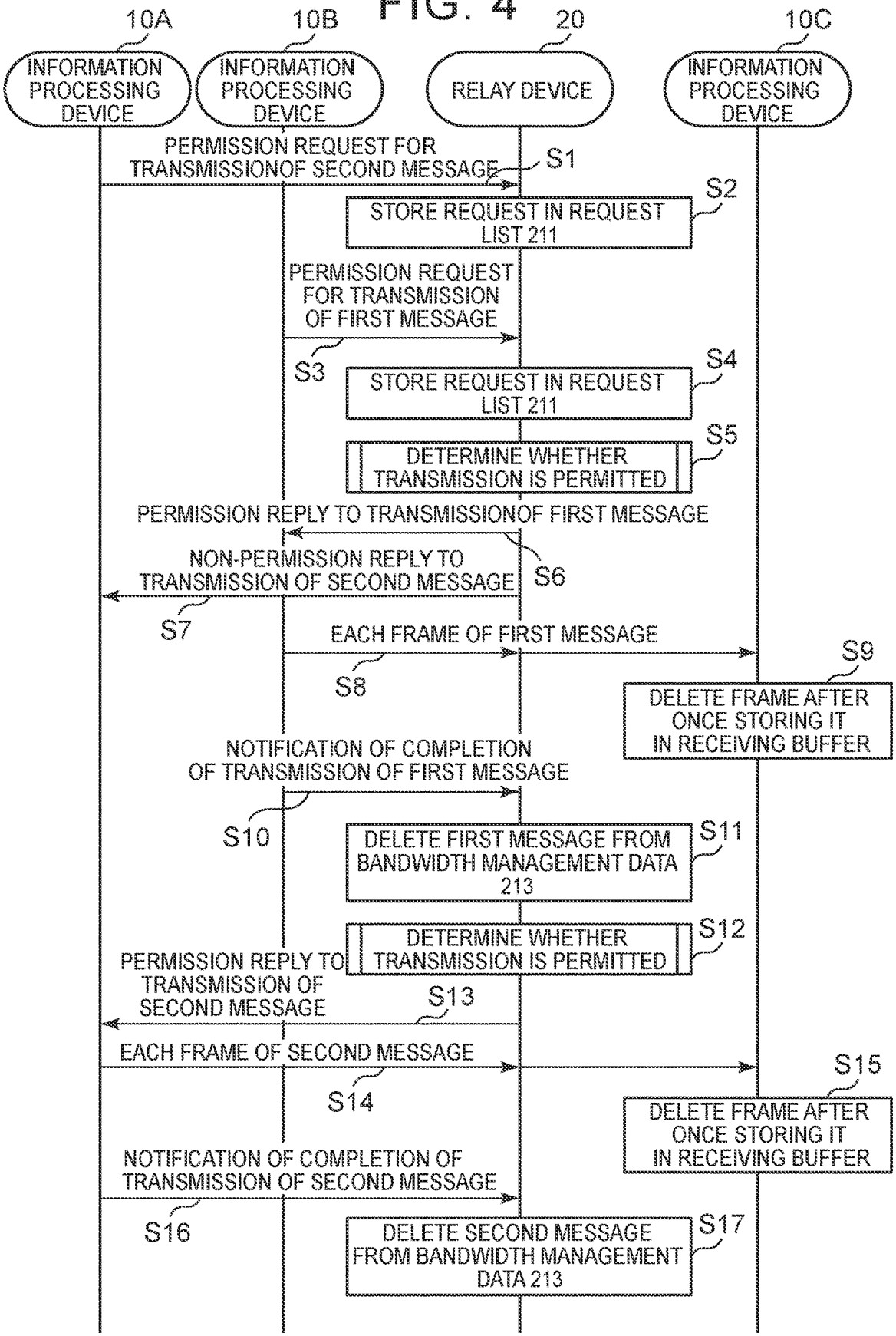
FIG. 4 is a sequence diagram illustrating one example of processing of the communication system according to the embodiment.

Referring next to FIG. 4 and FIG. 5, processing of the information processing system 1 according to the embodiment will be described. FIG. 4 is a sequence diagram illustrating one example of processing of the information processing system 1 according to the embodiment. In the case described below, an urgency flag of each message is set to "normal" (OFF). The processing described below may be carried out when a power supply of the vehicle 1001 (ignition power supply, or accessories power supply) is turned ON. In the following description, the information processing device 10A may be called "first on-vehicle device" and "third on-vehicle device", and the information processing device 10B may be called "first on-vehicle device", while the information processing device 10C may be called "second on-vehicle device".

In step S1, the transmitter 11 of the information processing device 10A sends a request to permit transmission of a second message, to the relay device 20. The request to permit transmission of the second message includes an ID (message ID) of the second message, data size of the second message, and the urgency flag.

Then, the receiver 22 of the relay device 20 stores the request to permit transmission of the second message, in the request list 211 (step S2). FIG. 5 shows one example of the request list 211 according to the embodiment. In the example of FIG. 5, the data size and the urgency flag are stored, in association with the message ID, in the request list 211. The message ID is identification information of the message to be transmitted. The data size is the data size of the message to be transmitted. The urgency flag is information indicating whether the degree of urgency of transfer of the message is high (denoted as "URGENT" in FIG. 5). In the example of FIG. 5, the data size of the message having a message ID "0001" is 30 KB, and the degree of urgency of transfer of the message is "NORMAL".

Then, the transmitter 11 of the information processing device 10B sends a request to permit transmission of a first message, to the relay device 20 (step S3). Here, the request to permit transmission of the first message includes the ID of the first message, data size of the first message, and the urgency flag.

Then, the receiver 22 of the relay device 20 stores the request to permit transmission of the first message, in the request list 211 (step S4).

Then, the determining unit 23 of the relay device 20 determines whether transmission of each message stored in the request list 211 is permitted (step S5). This operation may be performed when a predetermined time has elapsed from the time when the power supply of the vehicle 1001 was turned ON, for example.

In this step, the determining unit 23 of the relay device 20 deletes a message already permitted to be transmitted, from the request list 211, and stores the message in the bandwidth management data 213. The operation of step S5 will be described later. In the following description, it is assumed that the determining unit 23 of the relay device 20 does not permit transmission of the second message, but permits transmission of the first message.

Then, the replying unit 24 of the relay device 20 sends a reply indicating permission of transmission of the first message, to the information processing device 10B (step S6). Also, the replying unit 24 of the relay device 20 sends a reply indicating non-permission of transmission of the second message, to the information processing device 10A (step S7).

When the receiver 12 of the information processing device 10B receives the reply indicating permission of transmission of the first message, the transmitter 11 of the information processing device 10B divides the first message into a plurality of segments, and sends frames including respective segments, to the information processing device 10C, via the relaying unit 25 of the relay device 20 (step S8).

Then, the receiver 12 of the information processing device 10C sequentially stores the frames each including a part of the first message received, in a receiving buffer, and sequentially deletes the frames from the receiving buffer, once each frame stored in the receiving buffer is processed by the controller 13 of the information processing device 10C (step S9). The operation of step S9 is performed on each of the frames transmitted from the information processing device 10B in step S8.

Then, the transmitter 11 of the information processing device 10B sends a notification of completion of transmission of the first message, to the relay device 20 (step S10).

When the receiver 22 of the relay device 20 receives the notification of completion of transmission of the first message, it deletes the first message from the bandwidth management data 213 (step S11), and the determining unit 23 of the relay device 20 determines whether transmission of each message stored in the request list 211 is permitted (step S12).

In this connection, the determining unit 23 of the relay device 20 also executes step S11 and subsequent steps, when the receiver 22 does not receive the notification of completion of transmission of the first message, within the timeout period set in the bandwidth management data 213 for the first message, due to a failure of the information processing device 10B or information processing device 10C, for example.

Then, the replying unit 24 of the relay device 20 sends a reply indicating permission of transmission of the second message, to the information processing device 10A (step S13).

Then, when the receiver 12 of the information processing device 10A receives the reply indicating permission of transmission of the second message, the transmitter 11 of the information processing device 10A divides the second message into a plurality of segments, and sends frames including respective segments, to the information processing device 10C, via the relay device 20 (step S14).

Then, the receiver 12 of the information processing device 10C sequentially stores the frames each including a part of the second message received, in the receiving buffer, and sequentially deletes the frames from the receiving buffer (step S15) once each frame stored in the receiving buffer is processed by the controller 13 of the information processing device 10C.

Then, the transmitter 11 of the information processing device 10A sends a notification of completion of transmission of the second message, to the relay device 20 (step S16).

Then, the receiver 22 of the relay device 20 deletes the second message from the bandwidth management data 213 (step S17).

Figure 6:
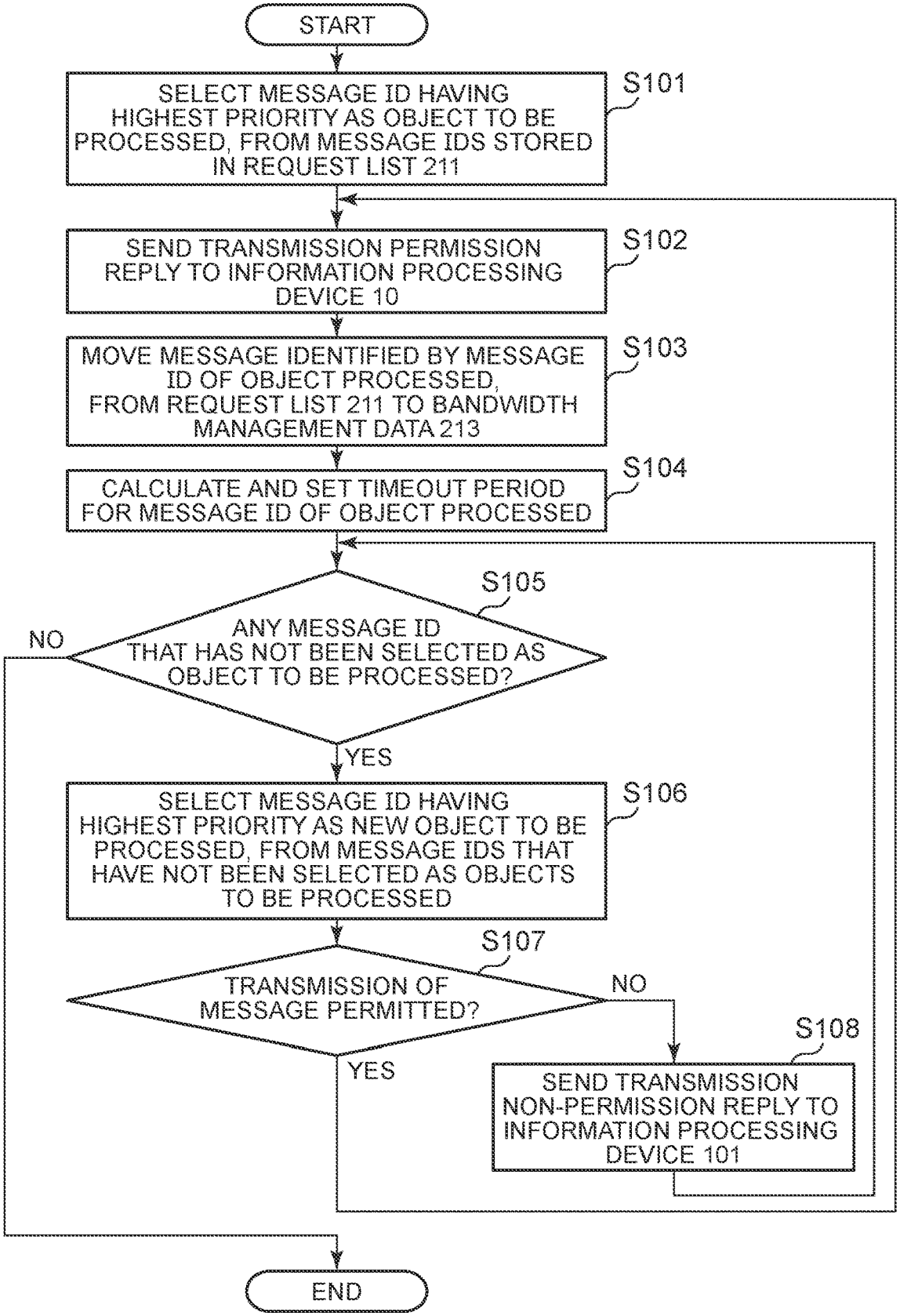
FIG. 6 is a flowchart illustrating one example of a process of determining whether each message stored in the request list can be transmitted.

Referring next to FIG. 6 to FIG. 8, operation performed by the determining unit 23 and replying unit 24 of the relay device 20 to determine whether transmission of each message stored in the request list 211 is permitted, and send a reply indicating the result of the determination, in step S5 and step S6, and step S12 and step S13 of FIG. 4, will be described. FIG. 6 is a flowchart illustrating one example of a process of determining whether transmission of each message stored in the request list 211 is permitted.

In step S101, the determining unit 23 selects a message ID of which the priority stored in the message management data 212 is the highest, as an object to be processed, from the message IDs stored in the request list 211.

FIG. 7 shows one example of the message management data 212 according to the embodiment. In the example of FIG. 7, the degree of priority and the usage rate of the bandwidth of each bus are stored in association with the message ID, in the message management data 212. The degree of priority is the priority of transmission of the message identified by the message ID. The usage rate of the bandwidth of each bus is the usage rate of the bandwidth of the bus between each information processing device 10 and the relay device 20, which is used by the message identified by the message ID. The usage rate of the bandwidth of each bus may be a value measured in advance, or a design value, for example. The message management data 212 may be set in advance in the relay device 20.

Then, the determining unit 23 causes the replying unit 24 to send a reply indicating permission of transmission of the message identified by the message ID to be processed, back to the information processing device 10 that sent the request to permit transmission of the message concerned (step S102).

Then, the determining unit 23 deletes the message identified by the message ID to be processed, from the request list 211, and stores the message in the bandwidth management data 213 (step S103). In this step, the usage rate of the bandwidth (transmission speed) between each pair of devices stored in the message management data 212 is stored in the bandwidth management data 213, in association with the message ID to be processed.

Then, the determining unit 23 calculates the timeout period, for the message identified by the message ID to be processed, based on the data size stored in the request list 211, and the usage rate of the bandwidth stored in the message management data 212, and stores the calculated timeout period in the bandwidth management data 213 (step S104). Here, the determining unit 23 may calculate the transmission speed from the usage rate of the bandwidth, and set a value obtained by adding a given offset value to a value obtained by dividing the data size by the transmission speed, or multiplying the value by the offset value, as the timeout period. In this case, when the bandwidth is 100 Mbps, and the usage rate is 30%, the transmission speed is calculated to be 30 Mbps. Where the data size is equal to 3 MB, the timeout period may be obtained by adding a given offset value to 80 ms (=3 M×8 bits/30 Mbps) or multiplying 80 ms by the given offset value.

FIG. 8 shows one example of the bandwidth management data 213 according to the embodiment. In the example of FIG. 8, the usage rate of the bandwidth of each bus, and the timeout period are stored, in association with the message ID, in the bandwidth management data 213.

Then, the determining unit 23 determines whether there is any message ID that has not been selected as an object to be processed, out of the message IDs stored in the request list 211 (step S105).

When one or more message IDs have not been selected as an object(s) to be processed (YES in step S105), the determining unit 23 selects a message ID having the highest propriety and stored in the message management data 212, as a new object to be processed, from the message IDs that have not been selected as objects to be processed (step S106).

Then, the determining unit 23 determines whether it can permit transmission of the message identified by the message ID to be processed (step S107). In this step, the determining unit 23 calculates, for each bus between each pair of devices, a total value of the usage rate of the bandwidth between the pair of devices associated with the message ID to be processed, and the respective usage rates of the bandwidth between the pair of devices stored in the bandwidth management data 213. Then, the determining unit 23 determines that transmission of the message cannot be permitted when at least one of the total values calculated for the respective buses is larger than a predetermined threshold value (e.g., 100%). If not (when the total values for all of the buses are equal to or smaller than the predetermined threshold value), the determining unit 23 determines that the transmission can be permitted.

When the determining unit 23 determines that the transmission can be permitted (YES in step S107), it proceeds to step S102. When the determining unit 23 determines that the transmission cannot be permitted (NO in step S107), it causes the replying unit 24 to send a reply indicating non-permission of transmission of the message identified by the message ID to be processed, back to the information processing device 10 that sent the request to permit transmission of the message concerned (step S108), and proceeds to step S105.

On the other hand, when there is no message ID that has not been selected as an object to be processed (step S105), the process of FIG. 6 ends.

Figure 9:
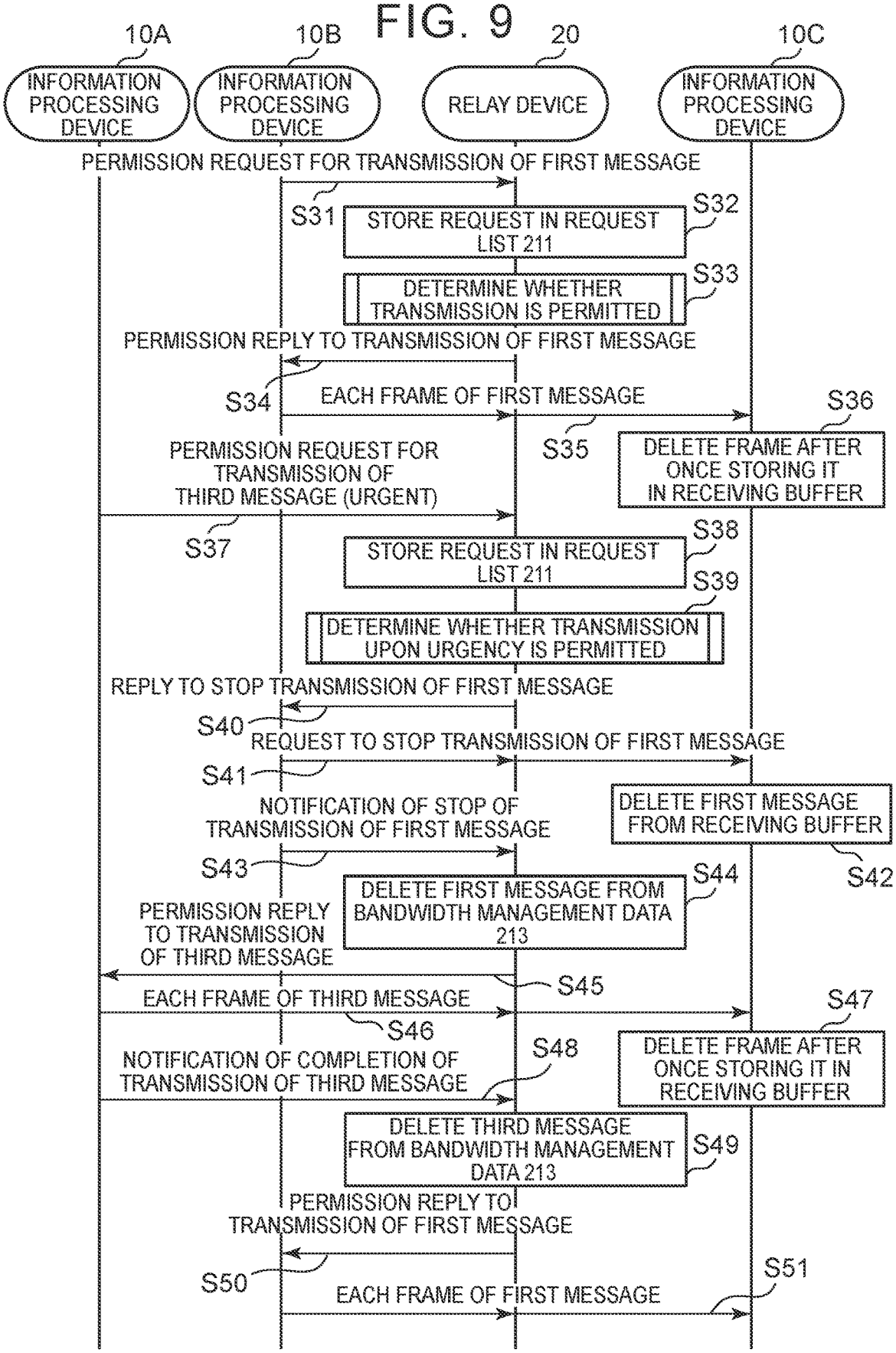
FIG. 9 is a sequence diagram illustrating one example of operation performed when an urgent message is received, in the information processing system according to the embodiment.

Referring next to FIG. 9, a process performed by the information processing system 1 according to the embodiment, when an urgent message is received, will be described. FIG. 9 is a sequence diagram showing one example of the process performed by the information processing system 1 according to the embodiment, when an urgent message is received. In the following description, the information processing device 10A may be called "fourth on-vehicle device", and the information processing device 10B may be called "first on-vehicle device".

In step S31, the transmitter 11 of the information processing device 10B sends a request to permit transmission of a first message, to the relay device 20.

Then, the receiver 22 of the relay device 20 stores the request to permit transmission of the first message, in the request list 211 (step S32).

Then, the determining unit 23 of the relay device 20 determines whether transmission of each message stored in the request list 211 is permitted (step S33). In the following description, it is assumed that transmission of the first message is permitted by the determining unit 23 of the relay device 20.

Then, the replying unit 24 of the relay device 20 sends a reply indicating permission of transmission of the first message, to the information processing device 10B (step S34).

When the receiver 12 of the information processing device 10B receives the reply indicating permission of transmission of the first message, the transmitter 11 of the information processing device 10B divides the first message into a plurality of segments, and sends frames including the respective segments, to the information processing device 10C, via the relaying unit 25 of the relay device 20 (step S35).

Then, the receiver 12 of the information processing device 10C sequentially stores the frames each including a part of the received first message, in the receiving buffer, and sequentially deletes the frames from the receiving buffer, once each frame stored in the receiving buffer is processed by the controller 13 of the information processing device 10C (step S36). The operation of step S36 is performed on each of the frames transmitted from the information processing device 10B in step S35.

Then, the transmitter 11 of the information processing device 10A sends a request to permit transmission of a third message, which is an urgent message of which the urgency flag is set to "URGENT" (ON), to the relay device 20 (step S37).

Then, the receiver 22 of the relay device 20 stores the request to permit transmission of the third message, in the request list 211 (step S38).

Then, the determining unit 23 of the relay device 20 determines whether transmission of each message stored in the request list 211 is permitted, in the case where the urgent message is received (step S39). The operation of step S39 will be described later. In the following description, it is assumed that the determining unit 23 of the relay device 20 permits transmission of the third message, but does not permit transmission of the first message.

Then, the replying unit 24 of the relay device 20 sends a reply indicating stop of transmission of the first message, to the information processing device 10B (step S40).

Then, the transmitter 11 of the information processing device 10B sends a request to stop transmission of the first message, to the information processing device 10C, via the relaying unit 25 of the relay device 20 (step S41). Here, when connection according to the Transmission Control Protocol (TCP) is established between the information processing device 10B and the information processing device 10C for sending and receiving of the first message, for example, the transmitter 11 of the information processing device 10B cuts off the connection.

Then, the receiver 12 of the information processing device 10C deletes a part of the first message stored in the receiving buffer, from the receiving buffer (step S42).

Then, the transmitter 11 of the information processing device 10B sends a notification of stop of transmission of the first message, to the relay device 20 (step S43).

When the receiver 22 of the relay device 20 receives the notification of stop of transmission of the first message, it deletes the first message from the bandwidth management data 213 (step S44).

Then, the replying unit 24 of the relay device 20 sends a reply indicating permission of transmission of the third message, to the information processing device 10A (step S45).

When the receiver 12 of the information processing device 10A receives the reply indicating permission of transmission of the third message, the transmitter 11 of the information processing device 10A divides the third message into a plurality of segments, and sends frames including the respective segments, to the information processing device 10C, via the relay device 20 (step S46).

Then, the receiver 12 of the information processing device 10C sequentially stores the frames each including a part of the received third message, in the receiving buffer, and sequentially deletes the frames from the receiving buffer, once each frame stored in the receiving buffer is processed by the controller 13 of the information processing device 10C (step S47).

Then, the transmitter 11 of the information processing device 10A sends a notification of completion of transmission of the third message, to the relay device 20 (step S48). Then, the receiver 22 of the relay device 20 deletes the third message from the bandwidth management data 213 (step S49). Then, the replying unit 24 of the relay device 20 sends a reply indicating permission of transmission of the first message, to the information processing device 10B (step S50).

When the receiver 12 of the information processing device 10B receives the reply indicating permission of transmission of the first message, the transmitter 11 of the information processing device 10B divides the first message into a plurality of segments, and sends frames including the respective segments, to the information processing device 10C, via the relaying unit 25 of the relay device 20 (step S51). In this step, the transmitter 11 of the information processing device 10B may send the first message again from the first segment. Alternatively, the transmitter 11 may send the first message again, from a segment requested to be transmitted again by the receiver 12 of the information processing device 10C.

Figure 10:
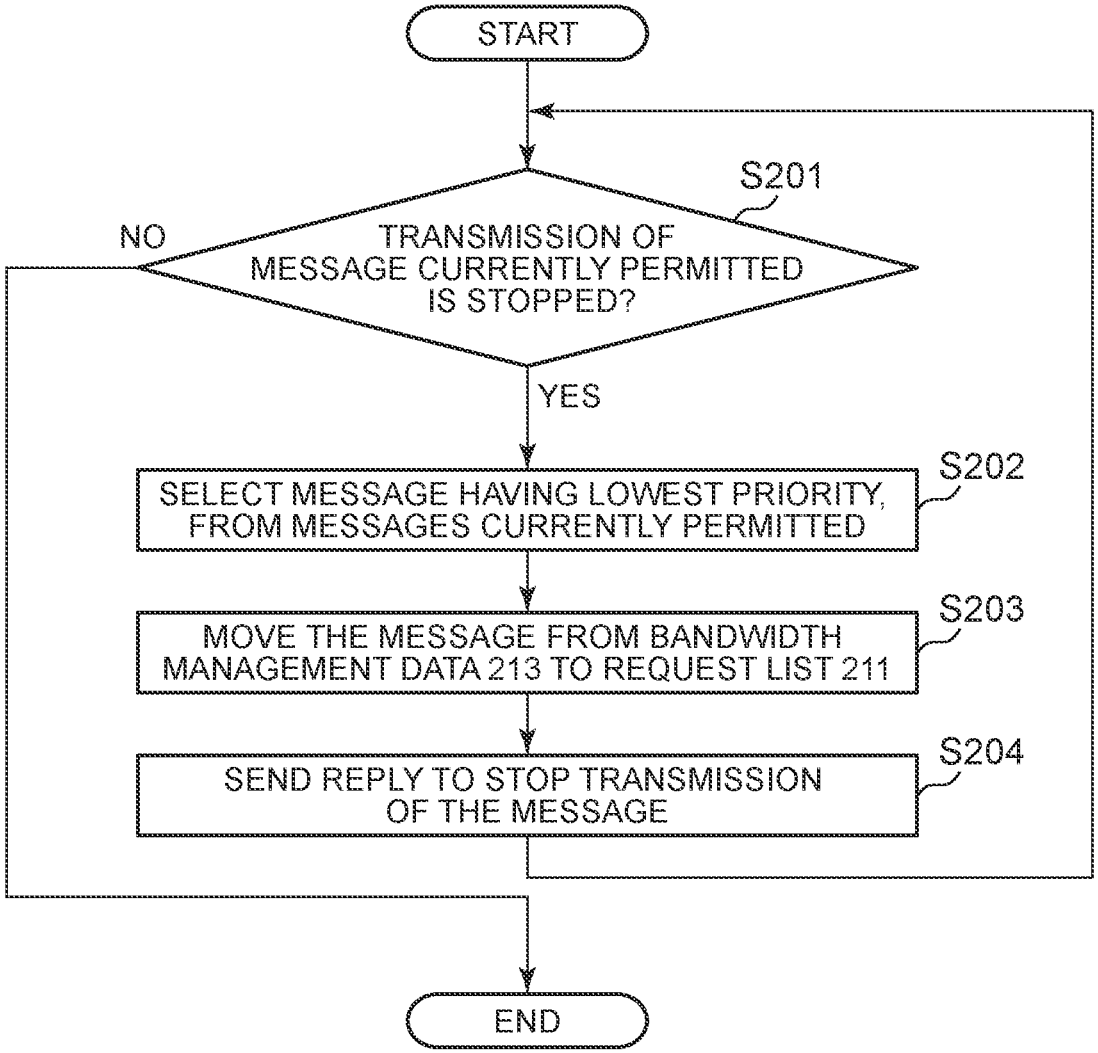
FIG. 10 is a flowchart illustrating one example of a process of determining whether transmission of each message is permitted, when an urgent message is received.

Referring next to FIG. 10, operation performed by the determining unit 23 and replying unit 24 of the relay device 20 to determine whether transmission is permitted when an urgent message is received, and send the reply, in step S39 and step S40 of FIG. 9, will be described. FIG. 10 is a flowchart illustrating one example of a process of determining whether transmission of each message is permitted when an urgent message is received.

In step S201, the determining unit 23 determines whether transmission of a message that is currently permitted to be transmitted is to be stopped. In this step, the determining unit 23 calculates, for each bus between each pair of devices, a total value of the usage rate of the bandwidth between the pair of devices associated with the message ID of the urgent message received, and the respective usage rates of the bandwidth between the pair of devices stored in the bandwidth management data 213. Then, the determining unit 23 determines that transmission of the message currently permitted to be transmitted is stopped, when at least one of the total values for the respective buses is larger than a predetermined threshold value (e.g., 100%). If not (when the total values for all of the buses are equal to or smaller than the predetermined threshold value), the determining unit 23 determines that transmission of the message currently permitted to be transmitted is not stopped.

When transmission of the message currently permitted to be transmitted is stopped (YES in step S201), the determining unit 23 selects a message having the lowest priority, from the messages currently permitted to be transmitted and stored in the bandwidth management data 213 (step S202). Then, the determining unit 23 deletes the message from the bandwidth management data 213, and stores a request to permit transmission of the message, in the request list 211 (step S203). In this manner, as in step S50 of FIG. 9, transmission of the message can be carried out again, when transmission of the urgent message is completed, for example.

Then, the determining unit 23 causes the replying unit 24 to send a reply indicating stop of transmission of the message, back to the information processing device 10 that sent the request to permit transmission of the message (step S204), and proceeds to step S201. On the other hand, when transmission of the message currently permitted to be transmitted is not stopped (NO in step S201), the process of FIG. 10 ends.

According to the embodiment as described above, when the relay device 20 receives a request to permit transmission of the first message, it sends back a reply that permits transmission of the first message, when the sum of the usage rate of the bandwidth of the network used by a message already permitted to be transmitted via the network, and the usage rate of the bandwidth of the network used by the first message is equal to or smaller than the predetermined threshold value. Thus, connection of communications having a possibility of occurrence of a packet loss can be prevented from being established; therefore, delay in communications can be reduced. Also, since the number of connections of communications established at the same time is reduced, delay in communications can be reduced, even when the capacity of RAM, or the like, installed on the information processing device 10 is relatively small.

While the embodiment of the disclosure has been described in detail, the disclosure is not limited to the particular embodiment, but may be embodied with various modifications or changes, within the scope of the disclosure as defined in the appended claims.

What is claimed is:

1. An on-vehicle relay device that is connected to two or more on-vehicle devices via an on-vehicle network, and relays a message transmitted from a first on-vehicle device as one of the two or more on-vehicle devices, to a second on-vehicle device as another one of the two or more on-vehicle devices, the on-vehicle relay device comprising a processor configured to:

receive a permission request for transmission of a first message from the first on-vehicle device;

determine whether a sum of a usage rate of a bandwidth of the on-vehicle network used by at least one message already permitted to be transmitted via the on-vehicle network, and the usage rate of the bandwidth of the on-vehicle network used by the first message is equal to or smaller than a predetermined threshold value; and send a reply that permits transmission of the first message, to the first on-vehicle device, when the sum is equal to or smaller than the predetermined threshold value, wherein the processor is configured to receive a permission request for transmission of a second message, from a third on-vehicle device as one of the two or more on-vehicle devices connected via the on-vehicle network, wherein the processor is configured to, when the processor receives a notification indicating completion of transmission of the first message permitted to be transmitted, from the first on-vehicle device, or does not receive the notification from the first on-vehicle device within a predetermined period, finish operation to transmit the first message, and determine whether a sum of the usage rate of the bandwidth of the on-vehicle network used by at least one message already permitted to be transmitted via the on-vehicle network, and the usage rate of the bandwidth of the on-vehicle network used by the second message that has not been permitted to be transmitted, is equal to or smaller than a predetermined threshold value, and wherein the processor is configured to send a reply that permits transmission of the second message, to the third on-vehicle device, when the sum is equal to or smaller than the predetermined threshold value.

2. The on-vehicle relay device according to claim 1, wherein the usage rate of the bandwidth of the on-vehicle network used by the first message is a pre-set value.

3. The on-vehicle relay device according to claim 1, wherein:

the processor is configured to receive a plurality of permission requests for transmission of a plurality of messages, from one or more of the two or more on-vehicle devices; and the processor is configured to, when the processor receives the permission requests, and a sum of usage rates of the bandwidth of the on-vehicle network used by the respective messages is equal to or smaller than a predetermined threshold value, send a reply that permits transmission of each of the plurality of messages, to a corresponding one of the one or more on-vehicle devices, in descending order of priority associated with each of the plurality of messages.

4. The on-vehicle relay device according to claim 1, wherein the processor is configured to calculate the predetermined period, based on a data size of the message permitted to be transmitted, and the usage rate of the bandwidth of the on-vehicle network used by the message.

5. The on-vehicle relay device according to claim 1, wherein the processor is configured to, when the processor receives a permission request for transmission of a third message, from a fourth on-vehicle device as one of the two or more on-vehicle devices connected via the on-vehicle network, send a reply that stops transmission of the first message permitted to be transmitted, to the first on-vehicle device, and send a reply that permits transmission of the third message, to the fourth on-vehicle device.

6. The on-vehicle relay device according to claim 5, wherein the third message has a higher urgency than the first message.

7. A vehicle having the on-vehicle relay device according to claim 1.

8. An on-vehicle relay device that is connected to two or more on-vehicle devices via an on-vehicle network, and relays a message transmitted from a first on-vehicle device as one of the two or more on-vehicle devices, to a second on-vehicle device as another one of the two or more on-vehicle devices, the on-vehicle relay device comprising a processor configured to:

receive a permission request for transmission of a first message from the first on-vehicle device;

determine whether a sum of a usage rate of a bandwidth of the on-vehicle network used by at least one message already permitted to be transmitted via the on-vehicle network, and the usage rate of the bandwidth of the on-vehicle network used by the first message is equal to or smaller than a predetermined threshold value; and send a reply that permits transmission of the first message, to the first on-vehicle device, when the sum is equal to or smaller than the predetermined threshold value, wherein the processor is configured to, when the processor receives a permission request for transmission of a third message, from a fourth on-vehicle device as one of the two or more on-vehicle devices connected via the on-vehicle network, send a reply that stops transmission of the first message permitted to be transmitted, to the first on-vehicle device, and send a reply that permits transmission of the third message, to the fourth on-vehicle device.

9. The on-vehicle relay device according to claim 8, wherein the third message has a higher urgency than the first message.

10. A method for connecting two or more on-vehicle devices to an on-vehicle relay device via an on-vehicle network, and relaying a message transmitted from a first on-vehicle device as one of the two or more on-vehicle devices, to a second on-vehicle device as another one of the two or more on-vehicle devices, the method comprising the steps of:

receiving a permission request for transmission of a first message from the first on-vehicle device;

determining whether a sum of a usage rate of a bandwidth of the on-vehicle network used by at least one message already permitted to be transmitted via the on-vehicle network, and the usage rate of the bandwidth of the on-vehicle network used by the first message is equal to or smaller than a predetermined threshold value;

sending a reply that permits transmission of the first message, to the first on-vehicle device, when the sum is equal to or smaller than the predetermined threshold value, receiving a request to permit transmission of a first message from the first on-vehicle device;

determining whether a sum of a usage rate of a bandwidth of the network used by at least one message already permitted to be transmitted via the network, and the usage rate of the bandwidth of the network used by the first message is equal to or smaller than a predetermined threshold value;

sending a reply that permits transmission of the first message, to the first on-vehicle device, when the sum is equal to or smaller than the predetermined threshold value, and receiving a permission request for transmission of a second message, from a third on-vehicle device as one of the two or more on-vehicle devices connected via the on-vehicle network, wherein, when a notification indicating completion of transmission of the first message permitted to be transmitted is received from the first on-vehicle device, or when the notification from the first on-vehicle device is not received within a predetermined period, the method further comprising the steps of:

finishing an operation to transmit the first message;

determining whether a sum of the usage rate of the bandwidth of the on-vehicle network used by at least one message already permitted to be transmitted via the on-vehicle network, and the usage rate of the bandwidth of the on-vehicle network used by the second message that has not been permitted to be transmitted, is equal to or smaller than a predetermined threshold value, and sending a reply that permits transmission of the second message, to the third on-vehicle device, when the sum is equal to or smaller than the predetermined threshold value.

11. The method according to claim 10, wherein the usage rate of the bandwidth of the on-vehicle network used by the first message is a pre-set value.

12. The method according to claim 10, further comprising the steps of:

receiving a plurality of permission requests for transmission of a plurality of messages, from one or more of the two or more on-vehicle devices; and when the processor receives the permission requests, and a sum of usage rates of the bandwidth of the on-vehicle network used by the respective messages is equal to or smaller than a predetermined threshold value, sending a reply that permits transmission of each of the plurality of messages, to a corresponding one of the one or more on-vehicle devices, in descending order of priority associated with each of the plurality of messages.

13. The method according to claim 10, wherein the predetermined period is calculated, based on a data size of the message permitted to be transmitted, and the usage rate of the bandwidth of the on-vehicle network used by the message.

14. The method according to claim 10, further comprising, when the processor receives a permission request for transmission of a third message, from a fourth on-vehicle device as one of the two or more on-vehicle devices connected via the on-vehicle network, the steps of:

sending a reply that stops transmission of the first message permitted to be transmitted, to the first on-vehicle device, and sending a reply that permits transmission of the third message, to the fourth on-vehicle device.

15. The method according to claim 10, wherein the third message has a higher urgency than the first message.

16. A method for connecting two or more on-vehicle devices to an on-vehicle relay device via an on-vehicle network, and relaying a message transmitted from a first on-vehicle device as one of the two or more on-vehicle devices, to a second on-vehicle device as another one of the two or more on-vehicle devices, the method comprising the steps of:

receiving a permission request for transmission of a first message from the first on-vehicle device;

determining whether a sum of a usage rate of a bandwidth of the on-vehicle network used by at least one message already permitted to be transmitted via the on-vehicle network, and the usage rate of the bandwidth of the on-vehicle network used by the first message is equal to or smaller than a predetermined threshold value;

sending a reply that permits transmission of the first message, to the first on-vehicle device, when the sum is equal to or smaller than the predetermined threshold value;

receiving a request to permit transmission of a first message from the first on-vehicle device;

determining whether a sum of a usage rate of a bandwidth of the network used by at least one message already permitted to be transmitted via the network, and the usage rate of the bandwidth of the network used by the first message is equal to or smaller than a predetermined threshold value; and sending a reply that permits transmission of the first message, to the first on-vehicle device, when the sum is equal to or smaller than the predetermined threshold value, wherein, when receiving a permission request for transmission of a third message, from a fourth on-vehicle device as one of the two or more on-vehicle devices connected via the on-vehicle network, the method further comprising the steps of:

sending a reply that stops transmission of the first message permitted to be transmitted, to the first on-vehicle device, and sending a reply that permits transmission of the third message, to the fourth on-vehicle device.

17. The method according to claim 16, wherein the third message has a higher urgency than the first message.

18. A system for connecting to two or more on-vehicle devices to an on-vehicle relay device via an on-vehicle network, and relaying a message transmitted from a first on-vehicle device as one of the two or more on-vehicle devices, to a second on-vehicle device as another one of the two or more on-vehicle devices, the on-vehicle relay device including a processor, the processor configured to:

receive a permission request for transmission of a first message from the first on-vehicle device;

determine whether a sum of a usage rate of a bandwidth of the on-vehicle network used by at least one message already permitted to be transmitted via the on-vehicle network, and the usage rate of the bandwidth of the on-vehicle network used by the first message is equal to or smaller than a predetermined threshold value; and send a reply that permits transmission of the first message, to the first on-vehicle device, when the sum is equal to or smaller than the predetermined threshold value, relay a message transmitted from the first on-vehicle device, to the second information processing device, receive a permission request for transmission of a first message from the first on-vehicle device, determine, when receiving the permission request, whether a sum of a usage rate of a bandwidth of the network used by at least one message already permitted to be transmitted via the network, and the usage rate of the bandwidth of the network used by the first message is equal to or smaller than a predetermined threshold value, and send a reply that permits transmission of the first message, to the first on-vehicle device, when the sum is equal to or smaller than the predetermined threshold value; and the first on-vehicle device configured to:

send the permission request for transmission of the first message, to the on-vehicle relay device, receive the reply that permits transmission of the first message from the on-vehicle relay device, and send the first message to the second on-vehicle device via the on-vehicle relay device, when receiving the reply, wherein the processor is further configured to receive a permission request for transmission of a second message, from a third on-vehicle device as one of the two or more on-vehicle devices connected via the on-vehicle network, wherein the processor is further configured to, when the processor receives a notification indicating completion of transmission of the first message permitted to be transmitted, from the first on-vehicle device, or does not receive the notification from the first on-vehicle device within a predetermined period, finish operation to transmit the first message, and determine whether a sum of the usage rate of the bandwidth of the on-vehicle network used by at least one message already permitted to be transmitted via the on-vehicle network, and the usage rate of the bandwidth of the on-vehicle network used by the second message that has not been permitted to be transmitted, is equal to or smaller than a predetermined threshold value, and wherein the processor is further configured to send a reply that permits transmission of the second message, to the third on-vehicle device, when the sum is equal to or smaller than the predetermined threshold value.

19. The system according to claim 18, wherein the processor is further configured to calculate the predetermined period, based on a data size of the message permitted to be transmitted, and the usage rate of the bandwidth of the on-vehicle network used by the message.

20. The system according to claim 18, wherein the processor is further configured to, when the processor receives a permission request for transmission of a third message, from a fourth on-vehicle device as one of the two or more on-vehicle devices connected via the on-vehicle network, send a reply that stops transmission of the first message permitted to be transmitted, to the first on-vehicle device, and send a reply that permits transmission of the third message, to the fourth on-vehicle device.

* * * * *